US005107868A

United States Patent [19]

Aryee

[11] Patent Number: 5,107,868

[45] Date of Patent: Apr. 28, 1992

[54] HAIR GRAPHICS

[76] Inventor: Frederick O. Aryee, 3790 32nd St., #E, San Diego, Calif. 92104

[21] Appl. No.: 756,968

[22] Filed: Sep. 9, 1991

[51] Int. Cl.[5] ..... A41G 5/00

[52] U.S. Cl. ..... 132/201; 132/212; 132/333

[58] Field of Search ..... 132/200, 201, 212, 215, 132/216, 319, 333; 434/159, 160, 161, 171, 172; 40/594, 595

[56] References Cited

U.S. PATENT DOCUMENTS

| | | | |
|---|---|---|---|
| 2,591,779 | 4/1952 | Buck | 40/595 |
| 2,775,048 | 12/1956 | Berman | 40/595 |
| 3,526,986 | 9/1970 | Dempnock et al. | 40/595 |
| 3,768,177 | 10/1973 | Thomas | 434/159 |
| 3,823,723 | 7/1974 | Miller | 132/201 |
| 4,024,879 | 5/1977 | Stryker | 132/216 |
| 4,235,459 | 11/1980 | Callahan | 40/594 |
| 4,264,666 | 4/1981 | Hix | 40/595 |
| 4,403,000 | 9/1983 | Gates | 40/594 |
| 4,964,428 | 10/1990 | Lamatrice | 132/216 |
| 5,033,486 | 7/1991 | Finamore et al. | 132/201 |

FOREIGN PATENT DOCUMENTS

| | | | |
|---|---|---|---|
| 2506056 | 8/1976 | Fed. Rep. of Germany | 40/594 |
| 1014894 | 12/1965 | United Kingdom | 40/595 |

*Primary Examiner*—Cary E. O'Connor
*Assistant Examiner*—Frank A. LaViola

[57] ABSTRACT

A hair styling technique provided for applying a message to the scalp in which letters or symbols having a planar base with scalp adhesive on one side and hair or hair-like fibers on the other side are adhered to the scalp in an arrangement that delivers the message.

4 Claims, 1 Drawing Sheet

HAIR GRAPHICS

BACKGROUND OF THE INVENTION

Current hair styles among young people often involve close-cropping the lower portion of the hair, or even shaving it off completely, while leaving a substantial amount of hair above a certain level on the scalp. The result in some cases looks like the old-fashioned "soup bowl" haircut, or it could be characterized as creating kind of an upside-down timber line.

In some circles, particularly among Afro-Americans, it is popular to have the hair sculptured by the barber to either spell out a message, or display a message symbol. Many barbers are happy to provide this service. Unfortunately, the barber will generally charge six to eight dollars per character, so that a message such as "I Love Vikki" would cost $60 to $80.

If the initial price were not an obstacle, then perhaps the fact that the individual would have to return to the barber shop at intervals of no more than once a week in order to maintain a reasonably clean message, would stop many people.

With word processing systems and computers, it is possible to prepare messages in a more high-tech fashion at almost no cost in a lot of other applications. If the same principles could be applied to the scalp messages, no doubt a cheaper and quicker way could be developed.

SUMMARY OF THE INVENTION

The instant invention provides the above-referenced cheaper and quicker way to apply messages to a scalp. Rather than sculpting the hair to spell the message or to display the message emblem, the letters of the alphabet and various symbols are provided as pre-cut, small "wiglets" of hair or fibers which resemble hair. Each individual "wiglet" is shaped to conform to the appearance of a letter of the alphabet or some other symbol. They are then adhered to the head with an adhesive that resists the oil secreted by the scalp, and which is hypoallergenic. They could be used to display an advertising message as well as an affectionate one.

DETAILED DESCRIPTION OF THE PREFERRED EMBODIMENT

Figure 1:
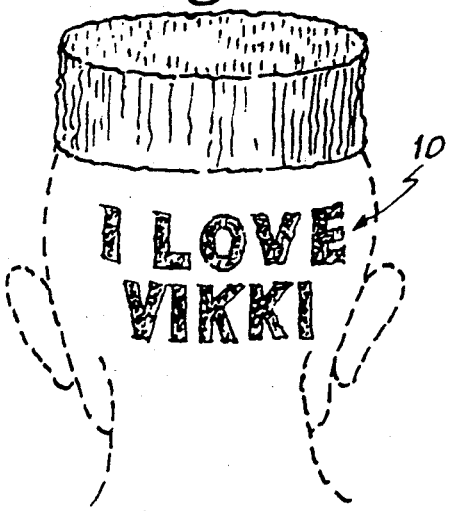
FIG. 1 is a rear elevation view of the head of a person displaying a personalized message.
Figure 4:
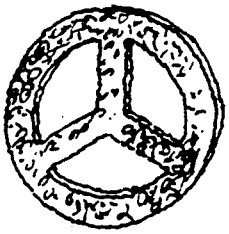
FIGS. 4 through 9 represent other symbols which could be applied to the scalp, either individually or in conjunction with an alphanumeric message.
Figure 5:
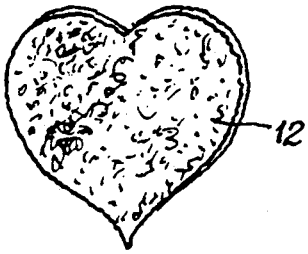
Figure 6:
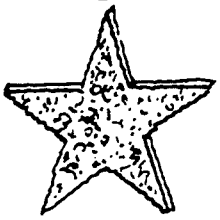
Figure 7:
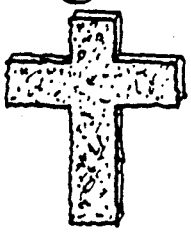
Figure 2:
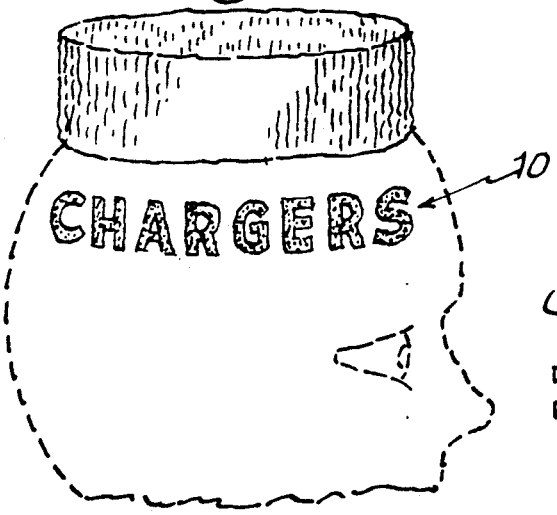
FIG. 2 is a side elevation view of the head of a person displaying another message.
Figure 8:
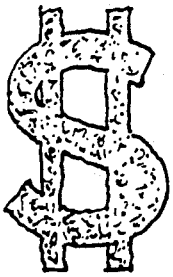
Figure 9:
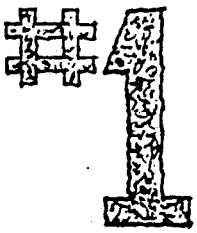
Figure 3:
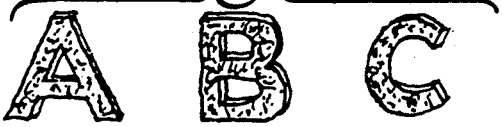
FIG. 3 is a front elevation view of alphabet symbols to be applied to the scalp

A typical display is illustrated at 10 in FIG. 1. This is the kind of display that is currently being done by sculpting the actual hair. A similar technique is applied to the scalp in FIG. 2, but on the side of the head. According to the presently disclosed technique, the letters of these messages are individually produced and are individually adhered with a suitable adhesive to the scalp, much in the way a movie marquee is changed.

There is a limitless repertory of symbols that can be applied to the scalp, as indicated in FIGS. 4 through 9, which illustrate six of them.

There are several different variations of construction that can be used to produce the symbols. At its most basic, all that is needed is a mass of hair and an adhesive to bond the hair to the scalp. Theoretically, a hair mat such as that shown in FIG. 11 at 12 could be used by simply applying adhesive to one side of the hair mass and pressing it onto the scalp. However, as a practical matter, the hair, when produced in mat form as at 12 or in the parallel-fibered crew cut style indicated at 14, some kind of base would be needed to hold the hair or hair-like fibers together. This could be some kind of adhesive matrix into which the hair is inserted, or against which the hair is pressed, when the matrix is wet. The matrix would then dry into a flexible layer which bonds the hair together, with a secondary adhesive being applied on the opposite side of the matrix from the hair to bond it to the scalp.

Figure 10:
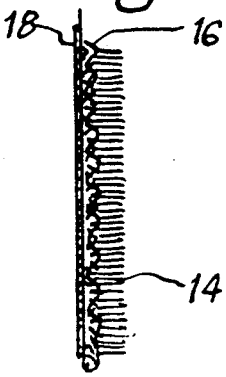
FIG. 10 illustrates a cross section of one manner creating a wiglet which has the appearance of a crew cut; and, FIG. 11 illustrates an alternative construction to that of FIG. 10 wherein a hair mat is adhered to the base rather than being interwoven with it.

However, probably the easiest and best way to make the symbols is to use a flexible planar base member such as a woven fabric, a matted fabric, or even an impervious fabric such as plastic, to provide a common plane for all the hair to bond to. The hair could then be attached to this base panel in several different ways. As shown in FIG. 10, it could be interwoven with the fibers 16 of the fabric panel 18 that is shown in FIG. 10. Wig hair is sometimes held together in this fashion. Clearly, this would work whether or not the hair is human hair, or some kind of synthetic. FIG. 10 illustrates such an interweaving technique used for parallel-fibered straight hair reminiscent of a crew cut. The interwoven hair technique could also be used with curly or kinky hair.

Figure 11:
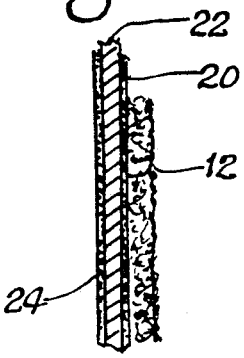

The other way of attaching the hair to the base member is through the use of an adhesive, indicated at 20 in FIG. 11. This adhesive is applied to the base member 22, interfacing it with the hair mass 12. Of course, the hair mass could also be parallel fibers as indicated at 14. When using glue, the configuration of the base member 22 is somewhat more flexible, permitting impervious materials such as plastic and very tightly woven nylon to be used.

On the first side of the fabric is the hair, and on the second surface is glue 24. Although the glue could be applied as the mass is applied to the scalp, it could also come with the applique unit, being covered by a slick peel-off sheet 26.

Figure 12:
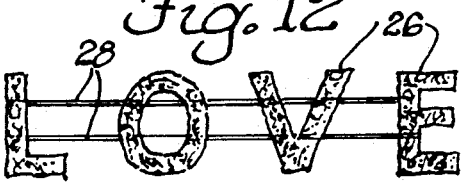
FIG. 12 is a front elevation view of alphabet symbols which are connected together by invisible threads to facilitate proper alignment of the symbols.

Although maximum flexibility of message is provided by using separate appliques, each of which representing one letter of the alphabet, to facilitate the alignment process and reduce application time, words could be connected together by invisible thread such as shown in FIG. 12. The transparent threads 28 would be invisible, or nearly invisible, against the scalp, but would serve to evenly space the letters, keeping each letter in its proper rotational orientation, so that only the levelness of the bottom of the letters must be established. No doubt other accessories could be provided such as jigs into which the letters are laid face-down, and then pressed against the scalp as a unit.

Although the invention does not represent a breakthrough in technology, nonetheless it represents a significant savings in time and money for those who are prone to have messages applied to their scalps.

It is hereby claimed:

1. An applique for being affixed to the human scalp comprising:

(a) a planar base member having a first and second surface and representing a symbol in planform;

(b) a mass of hair-like fibers being adhered to said first surface;

(c) an adhesive for coating said second surface and bonding said planar base with the fibers adhered thereto to the scalp; and (d) said planar base member having the planform shape of a character of the alphabet and being one of a set of such planar base members representing all the characters of the alphabet.

2. An applique for being affixed to the human scalp comprising:

(a) a planar base member having a first and second surface and representing a symbol in planform;

(b) a mass of hair-like fibers being adhered to said first surface; and (c) an adhesive for coating said second surface and bonding said planar base with the fibers adhered thereto to the scalp; and, (d) said planar base member, mass of hair-like fibers, and adhesive for coating said second surface being multiplied to define a plurality of applique elements, at least some of which being configured to resemble letters of the alphabet, and including a plurality of substantially invisible threads connected between said applique units to appropriately space same to facilitate correct application of the applique to the scalp.

3. A method of creating a message on a scalp comprising the following steps:

(a) shaving a portion of said scalp as necessary to create a substantially bald patch; and (b) taking at least one mass of hair-like fibers configured to resemble a message symbol, and adhering said at least one mass of hair-like fibers to the scalp.

4. A method according to claim 3 wherein said at least one mass of hair-like fibers is one of a plurality of masses of hair-like fibers, each of said masses representing one of the letters of the alphabet, and step (b) comprises adhering said masses to the scalp in an orderly fashion such that they spell out said message.

* * * * *